United States Patent [19]

Stern et al.

[11] Patent Number: 4,881,052

[45] Date of Patent: Nov. 14, 1989

[54] MILLIMETER WAVE MICROSTRIP NONRECIPROCAL PHASE SHIFTER

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 280,055

[22] Filed: Dec. 5, 1988

[51] Int. Cl.[4] ..... H01P 1/195

[52] U.S. Cl. ..... 333/24.1; 333/246

[58] Field of Search ..... 333/1.1, 24.1–24.3, 333/158

[56] References Cited

U.S. PATENT DOCUMENTS

| | | | |
|---|---|---|---|
| 3,686,590 | 8/1972 | Dischert | 333/24.1 |
| 4,458,218 | 7/1984 | Babbitt et al. | 333/158 |
| 4,816,787 | 3/1989 | Stern et al. | 333/158 |

OTHER PUBLICATIONS

"Microwave Ferrites and Ferrimagnetics", by Benjamin Lax, Ph.D. and Kenneth J. Button, Lincoln Laboratory, Massachusetts Institute of Technology, McGraw-Hill, 1962.

"Digital Phase Shifters", Tech Briefs, No. 652, Trans-Tech, Inc., 4/65.

*Primary Examiner*—Paul Gensler

*Attorney, Agent, or Firm*—Michael J. Zelenka; Robert A. Maikis

[57] ABSTRACT

A microstrip nonreciprocal latching phase shifter has a ferrite rod with ramp-shaped dielectric waveguide members at the ends thereof mounted on one surface of a microstrip dielectric substrate having a ground plane on the opposite surface thereof. The dielectric constants of the ramp members and the rod are substantially the same and the substrate dielectric constant is substantially less than the dielectric constant of the ramp members. A dielectric plate is on top of the rod. A microstrip conductor mounted on the substrate, the ramp members and the plate in axial alignment with the rod extends between the ends of the substrate. The rod has a rectangular longitudinally-extending passageway therein filled by a dielectric core insert having a dielectric constant greater than the dielectric constant of the rod. A single control wire is disposed in and aligned with the core insert. By selectively pulsing the control wire with reversible polarity current pulses, circular magnetic fields of reversible directions are created in the toroidal-shaped flux path formed in the rod around the wire, so that the rod acts as a twin slab type of phase shifter with respect to millimeter wave energy passing from one end of the microstrip conductor to the other end thereof.

7 Claims, 2 Drawing Sheets

MILLIMETER WAVE MICROSTRIP NONRECIPROCAL PHASE SHIFTER

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to microstrip transmission lines and microstrip transmission line components operating in the millimeter wave region of the frequency spectrum and more particularly to a microstrip nonreciprocal phase for use with such microstrip transmission lines and microstrip components.

2. Description of the Prior Art

Nonreciprocal phase shifters are devices employed to perform a nonreciprocal phase shift function in many types of RF circuits. For example, in the millimeter wave region of the frequency spectrum, nonreciprocal phase shifters are employed with phased antenna arrays for radar and communications applications, four-port switchable circulators, switches and power dividers. Since much of the equipment in this region of the frequency spectrum is designed with planar circuitry utilizing microstrip transmission lines and components, a need has arisen for a suitable microstrip nonreciprocal phase shifter which is capable of being used with this equipment. Although nonreciprocal phase shifters of the "twin slab" ferrite type have been developed for use with microwave applications utilizing the hollow, metallic waveguide transmission medium, there is presently not available a millimeter wave nonreciprocal phase shifter which is suitable for use with the aforementioned planar circuitry which uses the microstrip transmission line medium. Since the microstrip transmission components used in applications in the millimeter wave region of the frequency spectrum are of extremely small size and low weight, they are often difficult to fabricate and assemble using automated techniques. Accordingly, a suitable nonreciprocal microstrip phase shifter for use in this region of the frequency spectrum should be capable of being fabricated relatively easily and inexpensively and of being installed in the planar circuit applications relatively easily and inexpensively to minimize overall equipment cost. Additionally, a suitable nonreciprocal microstrip phase shifter should also exhibit a relatively low insertion loss in this region of the frequency spectrum.

SUMMARY OF THE INVENTION

It is an object of this invention to provide a nonreciprocal microstrip phase shifter which is suitable for use in the millimeter wave region of the frequency spectrum.

It is a further object of this invention to provide a millimeter wave microstrip nonreciprocal phase shifter of extremely small size and low weight which can be both fabricated and installed in microstrip transmission line applications relatively easily and inexpensively.

It is a still further object of this invention to provide a microstrip nonreciprocal phase shifter which has a relatively low insertion loss in the millimeter wave region of the frequency spectrum.

It is another object of this invention to provide a millimeter wave microstrip nonreciprocal phase shifter which is capable of being latched so that it exhibits either of two values of insertion phase by the application of a single current pulse and which requires no holding control current for operation.

It is an additional object of this invention to provide a millimeter wave microstrip nonreciprocal phase shifter which is especially suited for use in microstrip phased array antenna systems for radar and communications.

Briefly, the microstrip nonreciprocal phase shifter of the invention comprises a length of microstrip transmission line dielectric substrate having a pair of ends and top and bottom planar surfaces. An electrically conductive ground plane is mounted on the bottom surface of the substrate and a rectangular ferrite rod having four sides and a pair of ends is mounted on the top surface of the substrate with one of the rod sides abutting the substrate top surface and with the rod ends spaced a distance from the ends of the length of substrate. The ferrite rod has a dielectric constant greater than the dielectric constant of the substrate and a passageway disposed therein which extends along the longitudinal axis of the rod for at least a portion of the length of the rod so that the rod has a toroidal-shaped portion surrounding the passageway and extending the length of the passageway. The toroidal-shaped rod portion has a pair of walls disposed on opposite sides of the passageway which are substantially normal or perpendicular to the first-named rod side. A dielectric waveguide core member is disposed in the rod passageway and extends the length of the passageway. The dielectric core member has a dielectric constant which is at least as great as the dielectric constant of the ferrite rod. A dielectric plate is mounted on a second side of the rod which is parallel to the first-named rod side. The plate extends the length of the rod so that the ends of the plate are located at the ends of the rod. The dielectric plate has a dielectric constant which is substantially the same as the dielectric constant of the substrate. A pair of ramp-shaped dielectric waveguide members is mounted on the top surface of the substrate at the ends of the rod. Each of the ramp-shaped members has a dielectric constant which is substantially the same as the dielectric constant of the rod, a width which is substantially the same as the width of the rod, a planar bottom surface abutting the top surface of the substrate, an end surface abutting the end of the rod and the end of the plate adjacent thereto and a downwardly-sloping planar top surface extending between the end of the plate adjacent thereto and the top surface of the substrate. An electrically conductive microstrip conductor is mounted on the top surface of the plate, the top surfaces of the pair of ramp-shaped dielectric waveguide members and the top surface of the substrate in alignment with the longitudinal axis of the rod and extends between the ends of the length of substrate. Finally, selectively operable control wire means extending through the dielectric waveguide core member along the longitudinal axis of the rod are provided to create a reversible circular magnetic field in the toroidal-shaped portion of the rod surrounding the dielectric waveguide core member so that the rod acts as a twin wall or twin slab latching nonreciprocal phase shifter with respect to electromagnetic wave energy traveling along the microstrip conductor between the ends of the microstrip conductor.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
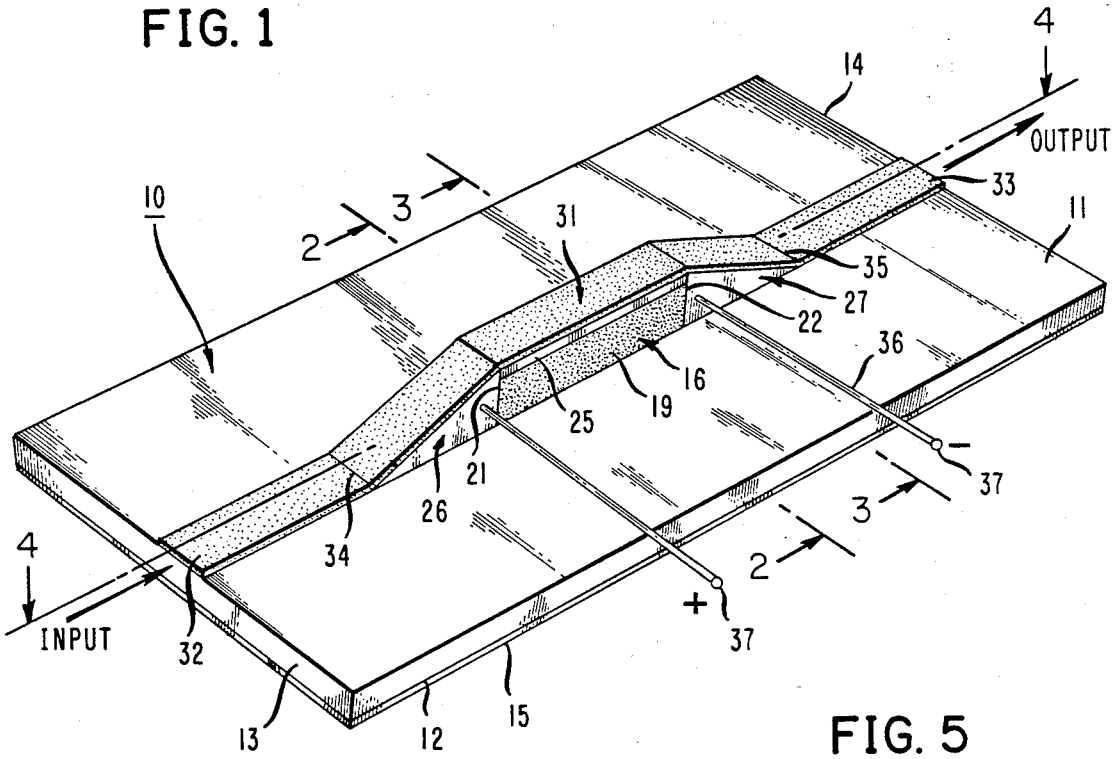
FIG. 1 is a perspective view of the microstrip nonreciprocal phase shifter of the invention.
Figure 5:
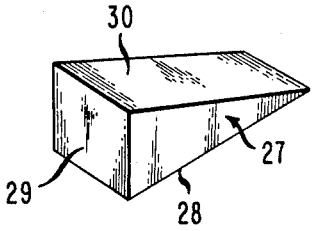
FIG. 5 is a perspective view of one of the ramp-shaped dielectric waveguide members shown in FIGS. 1 and 4.

Referring now to FIGS. 1–4 of the drawings, there is shown a microstrip nonreciprocal phase shifter constructed in accordance with the teachings of the present invention comprising a length of microstrip transmission line dielectric substrate, indicated generally as 10, having a planar top surface 11, a planar bottom surface 12 and a pair of ends 13 and 14. The substrate 10 may, for example, comprise a section of conventional microstrip transmission line substrate which is approximately 0.010 inch thick and which is fabricated of Duroid or other similar dielectric material having a relatively low dielectric constant. An electrically conductive ground plane 15 which is fabricated of a good conducting metal, such as copper or silver, for example, is mounted on the bottom surface 12 of the substrate and covers that entire surface.

Figure 2:
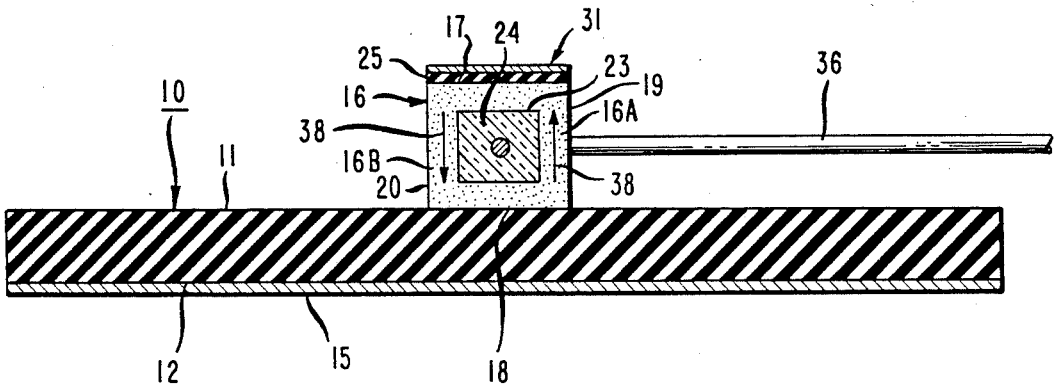
FIG. 2 is a full sectional view of the phase shifter taken along the line 2—2 of FIG. 1.
Figure 3:
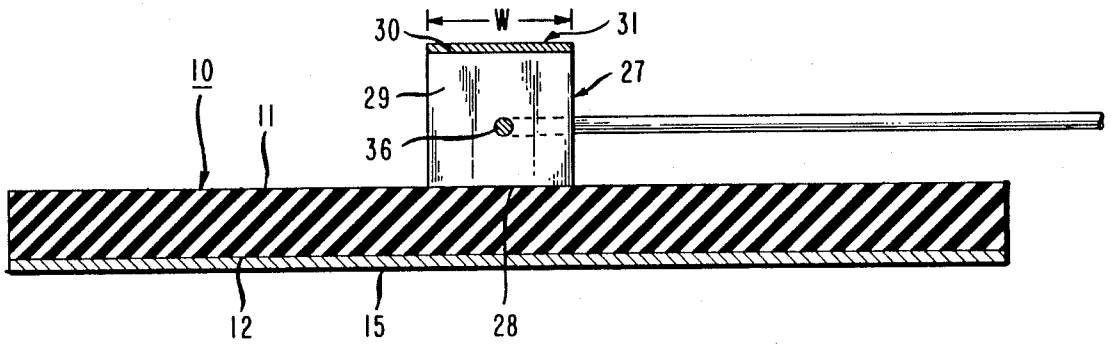
FIG. 3 is a full sectional view of the phase shifter taken along the line 3—3 of FIG. 1.

A rectangular ferrite rod, indicated generally as 16, having four sides 17, 18, 19 and 20 and a pair of ends 21 and 22 is mounted on the top surface 11 of the substrate 10 with one of the rod sides (the bottom side 18 is shown in FIG. 2) abutting the substrate top surface 11 and with the rod ends 21 and 22 spaced a distance from the corresponding ends 13 and 14 of the length of substrate 10. The rod 16 is fabricated of a ferrite material, such as nickel zinc ferrite or lithium zinc ferrite, for example, which exhibits gyromagnetic behavior in the presence of a unidirectional magnetic field. The dielectric constant of the ferrite rod 16 should be greater than the dielectric constant of the substrate 10. For example, if the substrate 10 is fabricated of Duroid, it would have a dielectric constant of 2.2 and if the ferrite rod is fabricated of nickel zinc ferrite, the rod would have a dielectric constant of 13.

Figure 4:
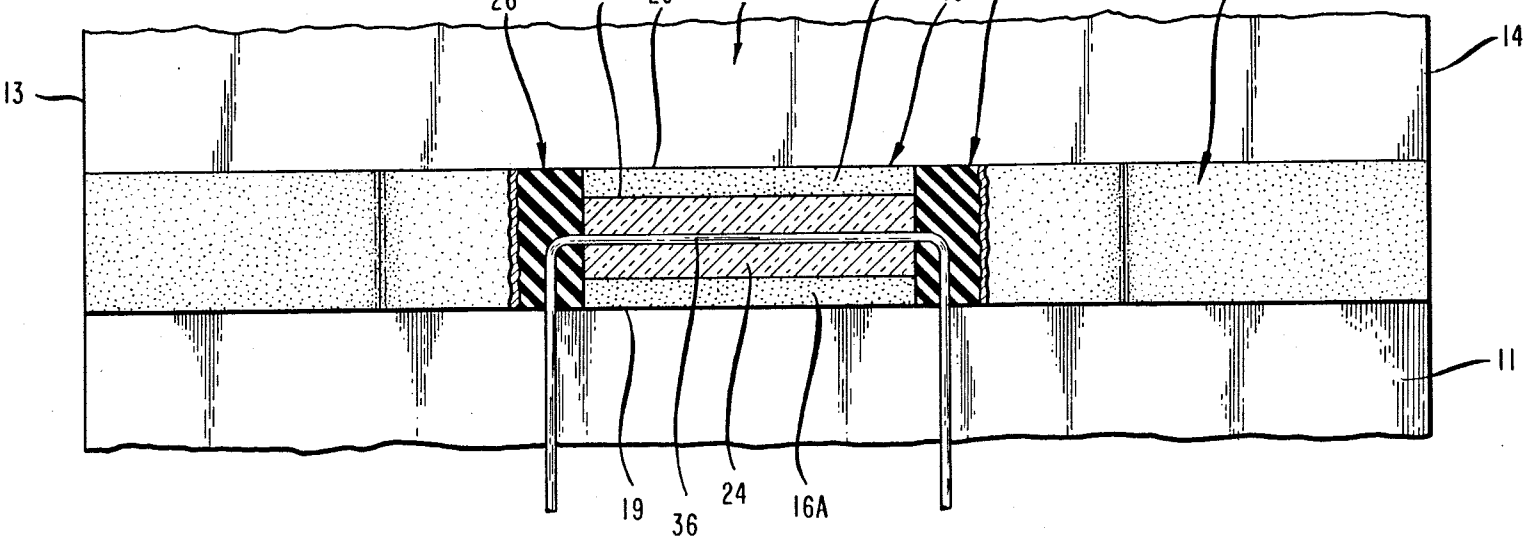
FIG. 4 is a full sectional view of the phase shifter taken along the line 4—4 of FIG. 1 with a portion of the substrate omitted for convenience of illustration.

As seen in FIGS. 2 and 4 of the drawings, the rod 16 has a passageway 23 disposed therein which extends along the longitudinal axis of the rod for the full length of the rod. The longitudinal axis of the rod may be visualized in FIG. 1 as extending along the two arrows labeled "Input" and "Output". As seen in FIG. 2, the passageway 23 in the rod causes the rod to be substantially toroidal-shaped and to have a pair of walls 16A and 16B which are disposed on opposite sides of the passageway. Each of the walls 16A and 16B is substantially normal or perpendicular to the bottom rod side 18.

A dielectric waveguide core member 24 is disposed in the passageway 23 in the rod and extends the full length of the passageway. The dielectric core member must have a dielectric constant which is at least as great and preferably greater than the dielectric constant of the rod. For example, if the rod is fabricated of nickel zinc ferrite which has a dielectric constant of 13, the dielectric waveguide core member 24 may be fabricated of magnesium titanate which normally has a dielectric constant of 13 but which may be "doped" in accordance with well-known practice to have a substantially higher dielectric constant. The dielectric core member 24 should be so sized as to completely fill the passageway 23 so that no air gaps exist between the sides of the core member 24 and the walls 16A and 16B of the rod 16.

As seen in FIG. 1 and 2, a dielectric plate 25 is mounted on the top surface 17 of the ferrite rod 16 and extends the full length of the rod so that the ends of the plate are located at the ends 21 and 22 of the rod. Since the rod side 17 is parallel to the rod side 18 which abuts the top surface 11 of the substrate, the dielectric plate 25 will be parallel to the top surface 11 of the substrate 10. The dielectric constant of the plate 25 should be substantially the same as the dielectric constant of the substrate 10 so that, for example, the plate may also be fabricated of Duroid. Although, for convenience of illustration, the thickness of the plate 25 is shown as being substantial in FIGS. 1 and 2, in practice the plate need only comprise a relatively thin plate.

As seen in FIGS. 1 and 3–5 of the drawings, a pair of ramp-shaped dielectric waveguide members, indicated generally as 26 and 27, is mounted on the top surface 11 of the substrate 10 at the opposite ends 21 and 22 of the rod 16 in alignment with the longitudinal axis of the rod. Each of the ramp-shaped members 26 and 27 has a width which is substantially the same as the width of the rod, a planar bottom surface which abuts the top surface of the substrate, an end surface which abuts the end of the rod and the end of the plate adjacent thereto and a downwardly-sloping planar top surface which extends between the end of the plate 25 adjacent thereto and the top surface 11 of the substrate. Since both of the ramp-shaped members are identical in construction, only one (ramp-shaped member 27) has been illustrated in detail in FIGS. 3 and 5 of the drawings. As seen therein, the ramp-shaped member 27 has a width W which is the same as the width of the rod 16, a planar bottom surface 28 which abuts the top surface 11 of the substrate 10, an end surface 29 which abuts the end 22 of the rod 16 and the end of the plate 25 adjacent thereto and a downwardly-sloping planar top surface 30 which extends between the end of the plate 25 adjacent thereto and the top surface 11 of the substrate. The other ramp-shaped member 26 has an end surface (not numbered) which abuts the other end 21 of the ferrite rod 16 so that the downwardly-sloping top surface (also not numbered) extends from the end of the plate 25 adjacent thereto to the top surface 11 of the substrate. The ramp-shaped dielectric waveguide members 26 and 27 should be fabricated of a material having a dielectric constant which is substantially the same as the dielectric constant of the ferrite rod 16. For example, if the ferrite rod is fabricated of nickel zinc ferrite, the ramp-shaped members may be conveniently fabricated of undoped magnesium titanate which also has a dielectric constant of 13.

Electrically conductive microstrip conductor means, indicated generally as 31, are mounted on the top surface of the dielectric plate 25, the downwardly-sloping top surfaces of the pair of ramp-shaped members 26 and 27 and the top surface 11 of the substrate 10 in alignment with the longitudinal axis of the ferrite rod 16. The microstrip conductor means 31 has an end 32 which is located at the end of the substrate 10 and an end 33 which is located at the substrate end 14 so that the microstrip conductor means extends between the ends 13 and 14 of the length of substrate 10. In practice, the microstrip conductor means 31 should be fabricated of a good electrically conductive material, such as copper or silver, for example. The microstrip conductor means may comprise a single length of microstrip conductor which extends between the ends 13 and 14 of the substrate 10. Alternatively, the microstrip conductor means may comprise a first length of microstrip conductor which extends from the end 13 of the substrate 10 to a first point, indicated as 34, where the downwardly-sloping top surface of the dielectric waveguide ramp-shaped member 26 which is closest to that end of the substrate meets the top surface 11 of the substrate, a second length of microstrip conductor which extends from the other end 14 of the substrate to a second point, identified as 35, where the downwardly-sloping top surface of the dielectric waveguide ramp-shaped member 27 which is closest to the substrate end 14 meets the top surface 11 of the substrate, a third length of microstrip conductor which extends between the first point 34 and the second point 35 and means, such as soldering, for example, at the first and second points 34 and 35 for electrically connecting the first, second and third lengths of microstrip conductor in series circuit. The latter alternative which makes use of three separate lengths of microstrip conductor may be desirable for certain applications because it permits the ferrite rod 16, the ramp-shaped members 26 and 27 and the dielectric plate 25 with the third length of microstrip conductor in place to be fabricated as a separate unit which is then merely dropped into place and soldered to the first and second lengths of microstrip conductor on a previously prepared section of microstrip transmission line dielectric substrate.

Finally, the microstrip nonreciprocal phase shifter of the invention provides selectively operable control wire means extending through the dielectric waveguide core member 24 along the longitudinal axis of the ferrite rod 16 for creating a reversible circular magnetic field in the toroidal-shaped rod surrounding the dielectric waveguide core member so that the ferrite rod acts as a twin wall or twin slab type of latching nonreciprocal phase shifter with respect to electromagnetic wave energy traveling through the ferrite rod 16. As seen in FIGS. 1 through 4 of the drawings, the selectively operable control wire means may take the form of a single control wire 36 which passes through the dielectric waveguide core member 24 along the longitudinal axis of the ferrite rod 16. The single length of control wire 36 also extends through the pair of ramp-shaped dielectric waveguide members 26 and 27 and exits from the ramp-shaped members through the triangular-shaped side surfaces (not numbered) of the ramp-shaped members to a pair of terminals 37.

By virtue of the foregoing arrangement, when the terminals 37 of the single control wire 36 are energized by a d.c. control voltage, a d.c. current will flow through the control wire 36 and thereby create a circular magnetic field in the toroidal-shaped ferrite rod 16 around the core member 24. For example, if the control terminals 37 are energized with a d.c. control voltage of the polarity shown in FIG. 1 of the drawings, a counterclockwise circular magnetic field shown by the arrows 38 in FIG. 2 of the drawings will be created in the toroidal-shaped rod surrounding the dielectric waveguide core member 24. It will be noted that the counterclockwise circular magnetic field in the ferrite rod 16 causes the twin walls 16A and 16B to have opposite directions of magnetization with respect to each other. If the polarity of the d.c. control voltage applied to the terminals 37 is reversed, the circular magnetic field in the ferrite rod will be reversed in direction and will become clockwise. However, even with a clockwise circular magnetization, the twin walls 16A and 16B will still be magnetized in opposite directions with respect to each other. Moreover, since the toroidal-shaped flux path in the ferrite rod 16 is a closed flux path and since the ferrite material has a square hysteresis loop, the toroidal-shaped ferrite rod may be latched into either of two magnetic states by applying a single current pulse of proper polarity to the terminals 37 of the control wire 36. For example, when a voltage pulse of the polarity shown in FIG. 1 is applied to the terminals 37, the counterclockwise direction of circular magnetization of the ferrite rod is produced and will be maintained until another current pulse of opposite polarity to that shown in FIG. 1 is applied to the terminals 37. When the control pulse of opposite polarity is applied, the clockwise direction of rod magnetization will be produced and will remain until a pulse of opposite polarity again is applied to the control terminals 37. Accordingly, no holding current is required for this device.

The terminals of the microstrip nonreciprocal phase shifter of the invention are formed by the ends 32 and 33 of the microstrip conductor means 31. In operation, when a millimeter wavelength signal is applied to the input terminal 32 of the device, it is transmitted along that portion of microstrip conductor means 31 which is mounted on the top surface 11 of the substrate because that portion of the microstrip conductor means 31 in conjunction with the ground plane 15 and the dielectric substrate 10 form a short section of a conventional microstrip transmission line. When the applied signal reaches the bottom (shown by the line 34) of the ramp-shaped dielectric waveguide member 26 it then passes along a microstrip transmission line which is formed by the portion of microstrip conductor means 31 which is on the upwardly-sloping top surface of the ramp-shaped member 26, the ground plane 15, the dielectric substrate 10 and the dielectric waveguide ramp-shaped member 26 itself. However, as the signal is progressing up the incline it begins to become transmitted by the solid dielectric waveguide material of the ramp-shaped member 26 because the dielectric constant of the ramp-shaped member 26 is substantially greater than the dielectric constant of the substrate 10.

When the applied signal reaches the top of the downwardly-sloping top surface of the ramp-shaped member 26 it becomes completely captured by the ferrite rod 16 which acts as a solid dielectric waveguide to transmit the applied signal along the length of the rod 16. At this point, the signal is now being transmitted by the solid waveguide mode of transmission rather than the microstrip mode of transmission. Assuming that the toroidal-shaped ferrite rod 16 has been latched into a magnetic state wherein the rod has a counterclockwise circular magnetic field as shown in FIG. 2, the ferrite rod will have an insertion phase of $\phi_1$ with respect to the applied signal.

The applied signal then passes down the short section of microstrip transmission line formed by the portion of microstrip conductor means 31 which is mounted on the top surface 30 of ramp-shaped member 27, ground plane 15, the substrate 10 and the ramp-shaped member 27 itself. As the applied signal travels down this section of the microstrip conductor means 31 the transmission mode gradually becomes converted from the solid dielectric waveguide mode of transmission to the microstrip mode of transmission. Accordingly, when the applied signal passes along the short section of microstrip conductor means 31 which is mounted on the top surface 11 of the substrate between the bottom 35 of ramp-shaped member 27 and the output terminal 33, it is again being transmitted entirely in the microstrip transmission line mode of propagation.

When it is desired to introduce a phase shift to the applied signal, the terminals 37 of control wire 36 are pulsed with a pulse of a polarity opposite to that shown in FIG. 1 of the drawings so that the toroidal-shaped ferrite rod 16 is latched into a second magnetic state wherein a clockwise circular magnetic field is produced in the ferrite rod. When this is done, the ferrite rod will exhibit a new insertion phase of $\phi_2$ with respect to the applied signal. Accordingly, the phase shift introduced would be $\phi_2$-$\phi_1$. Therefore, by reversing the polarity of an applied current pulse to the terminals of the control wire 36, the phase shifter may be shifted back and forth from the aforementioned states wherein it exhibits insertion phases of $\phi_1$ and $\phi_2$. It should be noted that $\phi_1$ and $\phi_2$ are the insertion phases which are produced when the toroidal-shaped flux path and the twin walls 16A and 16B are saturated in the counterclockwise and clockwise circular directions, respectively. Since these two states represent operation at opposite ends of the square hysteresis loop, $\phi_2$-$\phi_1$ represents the maximum value of phase shift obtainable with the length of ferrite rod employed. By varying the amplitude of the control current pulses applied to the control wire 36, the degree of magnetization of the core could be varied to thereby change the insertion phase values exhibited by the device.

It may also be noted that for a given or fixed magnetic state of the toroidal-shaped ferrite rod, a reversal of the direction of propagation of the applied RF electromagnetic wave energy through the ferrite rod will cause a change in the insertion phase of the device. For example, with the applied millimeter wavelength signal propagated through the ferrite rod 16 in the direction of the Input and Output arrows shown in FIG. 1, the phase shifter exhibits an insertion phase of $\phi_1$ when the ferrite rod is magnetized in a counterclockwise circular direction as shown in FIG. 2 and an insertion phase of $\phi_2$ when the ferrite rod is magnetized in the clockwise direction. If the direction of propagation of the applied millimeter wavelength signal were reversed so that the signal was applied to terminal 33 of the phase shifter rather than terminal 32 and assuming the ferrite rod was latched in the counterclockwise circular direction as shown in FIG. 2, the phase insertion of the device would be $\phi_2$ rather than $\phi_1$. If the circular direction of magnetization of the rod was then reversed to the clockwise direction, the insertion phase exhibited by the device with respect to a signal applied to terminal 33 rather than terminal 32 would be $\phi_1$.

The theory of operation and performance of the twin slab type of ferrite latching nonreciprocal phase shifters is well known in the waveguide transmission arts and will not be discussed further herein. It may be noted, however, that although the passageway 23 in the ferrite rod 16 is shown as extending the entire length of the rod that for some applications the passageway need only extend a short distance along the longitudinal axis of the rod so that only that portion of the rod which surrounds the passageway would have a toroidal shape. However, this could limit the total amount of phase shift available from the length of ferrite rod employed in the device. For example, with a phase shifter constructed as illustrated and described herein it is estimated that at least 360 degrees of nonreciprocal phase shift per inch of ferrite rod would be achievable for operation in the 35 GHz frequency region. Additionally, it may be noted that although the passageway 23 in the ferrite rod 16 is shown and described herein as having a rectangular cross-section, it would be possible to utilize passageways having circular or elliptical cross-sections. Although passageways having circular or elliptical cross-sections would provide a closed flux path around the passageway, it is apparent that the length of the twin walls or slabs would consequently be reduced so that less efficient operation of the phase shifter would result.

It is believed apparent that many changes could be made in the construction and described uses of the foregoing microstrip nonreciprocal latching phase shifter and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. A microstrip nonreciprocal phase shifter comprising a length of microstrip transmission line dielectric substrate having a pair of ends and top and bottom planar surfaces;

an electrically conductive ground plane mounted on the bottom surface of said substrate;

a rectangular ferrite rod having four sides and a pair of ends mounted on the top surface of said substrate with one of said rod sides abutting said substrate top surface and with said rod ends spaced a distance from the ends of said length of substrate, said rod having a dielectric constant greater than the dielectric constant of said substrate and a passageway therein extending along the longitudinal axis of the rod for at least a portion of the length of the rod so that the rod has a toroidal-shaped portion surrounding said passageway and extending the length of the passageway, said toroidal-shaped rod portion having a pair of walls disposed on opposite sides of said passageway which are substantially normal to said first-named rod side;

a dielectric waveguide core member disposed in said rod passageway and extending the length of said passageway, said dielectric core member having a dielectric constant which is at least as great as the dielectric constant of said rod;

a dielectric plate mounted on a second side of said rod which is parallel to said first-named rod side, said plate extending the length of the rod so that the ends of the plate are located at the ends of said rod and having a dielectric constant which is substantially the same as the dielectric constant of said substrate;

a pair of ramp-shaped dielectric waveguide members mounted on the top surface of said substrate at the ends of said rod, each of said ramp-shaped members having dielectric constant which is substantially the same as the dielectric constant of said rod, a width which is substantially the same as the width of said rod, a planar bottom surface abutting the top surface of said substrate, an end surface abutting the end of said rod and the end of said plate adjacent thereto and a downwardly-sloping top surface extending between the end of said plate adjacent thereto and the top surface of said substrate;

electrically conductive microstrip conductor means mounted on the top surface of said plate, the top surface of said pair of ramp-shaped dielectric waveguide members and the top surface of said substrate in alignment with the longitudinal axis of said rod and extending between the ends of said length of substrate; and selectively operable control wire means extending through said dielectric waveguide core member along the longitudinal axis of said rod for creating a reversible circular magnetic field in said toroidal-shaped portion of said rod surrounding said dielectric waveguide core member so that said rod acts as a twin wall latching nonreciprocal phase shifter with respect to electromagnetic wave energy traveling along said microstrip conductor means between the ends of said microstrip conductor means.

2. A microstrip nonreciprocal phase shifter as claimed in claim 1 wherein said passageway in said ferrite rod has rectangular-shaped transverse cross-section.

3. A microstrip nonreciprocal phase shifter as claimed in claim 1 wherein said passageway in said ferrite rod extends the entire length of said rod.

4. A microstrip nonreciprocal phase shifter as claimed in claim 1 wherein said selectively operable control wire means is a single control wire.

5. A microstrip nonreciprocal phase shifter as claimed in claim 4 wherein each of said pair of ramp-shaped dielectric waveguide members has two triangular-shaped side surface disposed on opposite sides of the ramp-shaped member which are normal to the bottom surface of the ramp-shaped member, said passageway in said ferrite rod extends the entire length of said rod, and said single control wire also extends through said pair of ramp-shaped dielectric waveguide members and exits said ramp-shaped members through said triangular-shaped side surfaces of said ramp-shaped members.

6. A microstrip nonreciprocal phase shifter as claimed in claim 5 wherein said electrically conductive microstrip conductor means comprises a first length of microstrip conductor extending from one of the ends of said length of substrate to a first point where the downwardly-sloping top surface of the dielectric waveguide ramp-shaped member closest to said one substrate end meets the top surface of said substrate, a second length of microstrip conductor extending from the other of the ends of said length of substrate to a second point where the downwardly-sloping top surface of the dielectric waveguide ramp-shaped member closest to said other substrate end meets the top surface of said substrate, a third length of microstrip conductor extending between said first point and said second point, and means at said first and second points for electrically connecting said first, second and third lengths of microstrip conductor in series circuit.

7. A microstrip nonreciprocal phase shifter as claimed in claim 5 wherein said electrically conductive microstrip conductor means comprises a single length of microstrip conductor extending between the ends of said substrate.

* * * * *